US009589755B1

(12) United States Patent
Singer et al.

(10) Patent No.: US 9,589,755 B1
(45) Date of Patent: Mar. 7, 2017

(54) CIRCUIT BREAKER HAVING A FRAMED FINGER AREA

(71) Applicant: Sensata Technologies, Inc., Attleboro, MA (US)

(72) Inventors: Keith A. Singer, Attleboro, MA (US); Clifford Buxton, Bellefontaine, OH (US)

(73) Assignee: SENSATA TECHNOLOGIES, INC., Attleboro, MA (US)

( * ) Notice: Subject to any disclaimer, the term of this patent is extended or adjusted under 35 U.S.C. 154(b) by 0 days.

(21) Appl. No.: 15/139,897

(22) Filed: Apr. 27, 2016

(51) Int. Cl.
*H01H 9/02* (2006.01)
*H01H 71/02* (2006.01)

(52) U.S. Cl.
CPC ..... *H01H 71/0264* (2013.01)

(58) Field of Classification Search
CPC .... H01H 71/521; H01H 71/0214; H01H 9/28; H01H 9/287
USPC ..... 200/293, 43.16, 304, 333
See application file for complete search history.

(56) References Cited

U.S. PATENT DOCUMENTS

| | | | | |
|---|---|---|---|---|
| 2,246,298 | A | 6/1941 | Dyer et al. | |
| 3,198,906 | A | 8/1965 | Frink et al. | |
| 4,042,894 | A | 8/1977 | Coleman | |
| 4,789,848 | A | 12/1988 | Castonguay et al. | |
| 5,148,910 | A * | 9/1992 | Williams | H01H 9/286 200/321 |
| 6,137,068 | A * | 10/2000 | Padulo | H01H 9/287 200/333 |
| 6,160,227 | A | 12/2000 | Singer | |
| 6,239,962 | B1 | 5/2001 | Seymour et al. | |
| 7,268,654 | B2 | 9/2007 | Dorn et al. | |
| 7,863,534 | B2 | 1/2011 | Narayanasamy et al. | |

* cited by examiner

*Primary Examiner* — Vanessa Girardi
(74) *Attorney, Agent, or Firm* — Adler Pollock & Sheehan P.C.; George N. Chaclas; Daniel J. Holmander

(57) ABSTRACT

A switch assembly including a housing. An escutcheon portion on the front surface of the housing has a raised platform. A transition ramp extends from the platform to a rest area and a finger area is adjacent the rest area. A perimeter frame encloses the finger area so that the escutcheon portion defines opposing notches aligned with the rest area. A handle has a hub with an axial bore so that a pivot pin insert through the axial bore rotatably couples the handle to the housing. A finger grip extends from the hub. The finger grip has a surface for selectively abutting against the rest area and a textured portion for manual actuation when a finger in inserted into the finger area.

21 Claims, 15 Drawing Sheets

CIRCUIT BREAKER HAVING A FRAMED FINGER AREA

BACKGROUND OF THE INVENTION

1. Field of the Invention

The subject disclosure relates to switches, and more particularly to circuit breaker type switches with safety features preventing inadvertent operation of the switch.

2. Background of the Related Art

Circuit breakers are well-known devices that automatically trip to interrupt an electrical path in a monitored circuit for safety when circuit fault conditions occur. For example, a fault condition may be an over voltage condition, an arcing fault, current overload or a ground faults. In a typical circuit breaker, a latching mechanism maintains engagement of the circuit breaker contacts. However, the latching mechanism is also sensitive enough to trip quickly and reliably under fault conditions. The circuit interruption is usually achieved by having a movable contact separate from a stationary contact. Many variations of latching mechanism are possible such as shown in U.S. Pat. No. 2,246,298 issued Jun. 17, 1941 to Dyer et al., U.S. Pat. No. 2,439,511 issued Apr. 13, 1948 to Green, U.S. Pat. No. 3,198,906 issued Aug. 3, 1965 to Frink et al., U.S. Pat. No. 4,042,894 issued Aug. 16, 1977 to Coleman, U.S. Pat. No. 4,789,848 issued Dec. 6, 1988 to Castonguay et al., U.S. Pat. No. 6,239,962 issued May 29, 2001 to Seymour et al., U.S. Pat. No. 7,268,654 issued Sep. 11, 2007 to Dorn et al., and U.S. Pat. No. 7,863,534 issued Jan. 4, 2011 to Narayanasamy.

Circuit breakers with toggle switches are well-known for providing manual activation of the circuit breaker between "on" and "off" positions. However, toggle switches are prone to accidental actuation from both positions. The cost of such accidental actuation can be significant. As a result, various stops have been invented to prevent such accidental operation. See, for example, U.S. Pat. No. 6,160,227 issued Dec. 12, 2000 to Singer. Other devices like rocker switches have also been developed to prevent accidental actuation. Rocker switches require handle linkages among other features that undesirably create larger devices.

SUMMARY OF THE INVENTION

In view of the above, a need exists for a switch with a low profile and safe handle configuration that would not easily be inadvertently actuated.

The present disclosure is directed to a switch assembly including a housing defining an interior. The housing has a front surface, a rear surface opposing the front surface, and opposing first and second sidewalls extending between the front and rear surfaces to form a substantially enclosed rectangular box. An escutcheon portion on the front surface includes a platform. A transition ramp extends from the platform to a rest area. A finger area is adjacent the rest area and a perimeter frame encloses the finger area so that the escutcheon portion defines opposing notches aligned with the rest area. A handle has a hub rotatably mounted in the interior. A finger grip of the handle extends from the hub through a slot formed in the transition ramp. The finger grip has a textured portion and a surface for abutting against the rest area in a first position. The handle selectively moves to a second position by manual operation or automatically when a predetermined condition is met. Preferably, the handle includes webbing and the housing defines opposing slots for rotatably receiving the webbing and supporting the handle in the interior.

In another embodiment, the handle defines an axial bore through the hub and a frame mounts to the housing with opposing arms, each arm having a distal end defining an opening. A pivot pin inserted through the openings of the arm's distal ends and the axial bore to rotatably couple the handle to the frame. The handle may have safety protrusions extending from the hub. The planar rest area is typically substantially co-planar with the front surface. The finger grip of the handle may define an axial passage extending between the notches when the handle is in the first position.

Another embodiment of the present disclosure includes an escutcheon portion of a switch assembly having a housing having a front surface. The escutcheon portion includes a platform on the front surface, a planar rest area separated from the platform and relatively lower with respect to the platform, a transition ramp extending from the platform to the planar rest area, a finger area adjacent the planar rest area, and a perimeter frame enclosing the finger area so that the escutcheon portion defines opposing notches aligned with the planar rest area. The transition ramp may define a slot for allowing rotational movement of a handle rotatably mounted in an interior of the housing, the handle having a finger grip with a planar surface for selectively abutting against the rest area in a first portion and a textured portion for manual actuation by placement of a finger in the finger area. Typically, the platform is raised above the front surface.

Still another embodiment of the present disclosure includes a switch assembly including a housing defining an interior and having a front surface. A rear surface opposes the front surface and opposing first and second sidewalls extend between the front and rear surfaces. An escutcheon portion on the front surface has a raised platform. A transition ramp extends from the platform to a planar rest area and a finger area is adjacent the planar rest area. A perimeter frame encloses the finger area so that the escutcheon portion defines opposing notches aligned with the planar rest area. A handle has a hub with an axial bore so that a pivot pin insert through the axial bore rotatably couples the handle to a frame and/or the housing. A finger grip extends from the hub. The finger grip has a planar surface for selectively abutting against the rest area and a textured portion for manual actuation when a finger in inserted into the finger area. If a frame is used to support the handle, the frame mounts to the housing and has opposing arms. Each arm has a distal end that defines an opening for receiving the pivot pin.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed technology appertains will more readily understand how to make and use the same, reference may be had to the following drawings.

DETAILED DESCRIPTION OF PREFERRED EMBODIMENTS

Figure 1A:
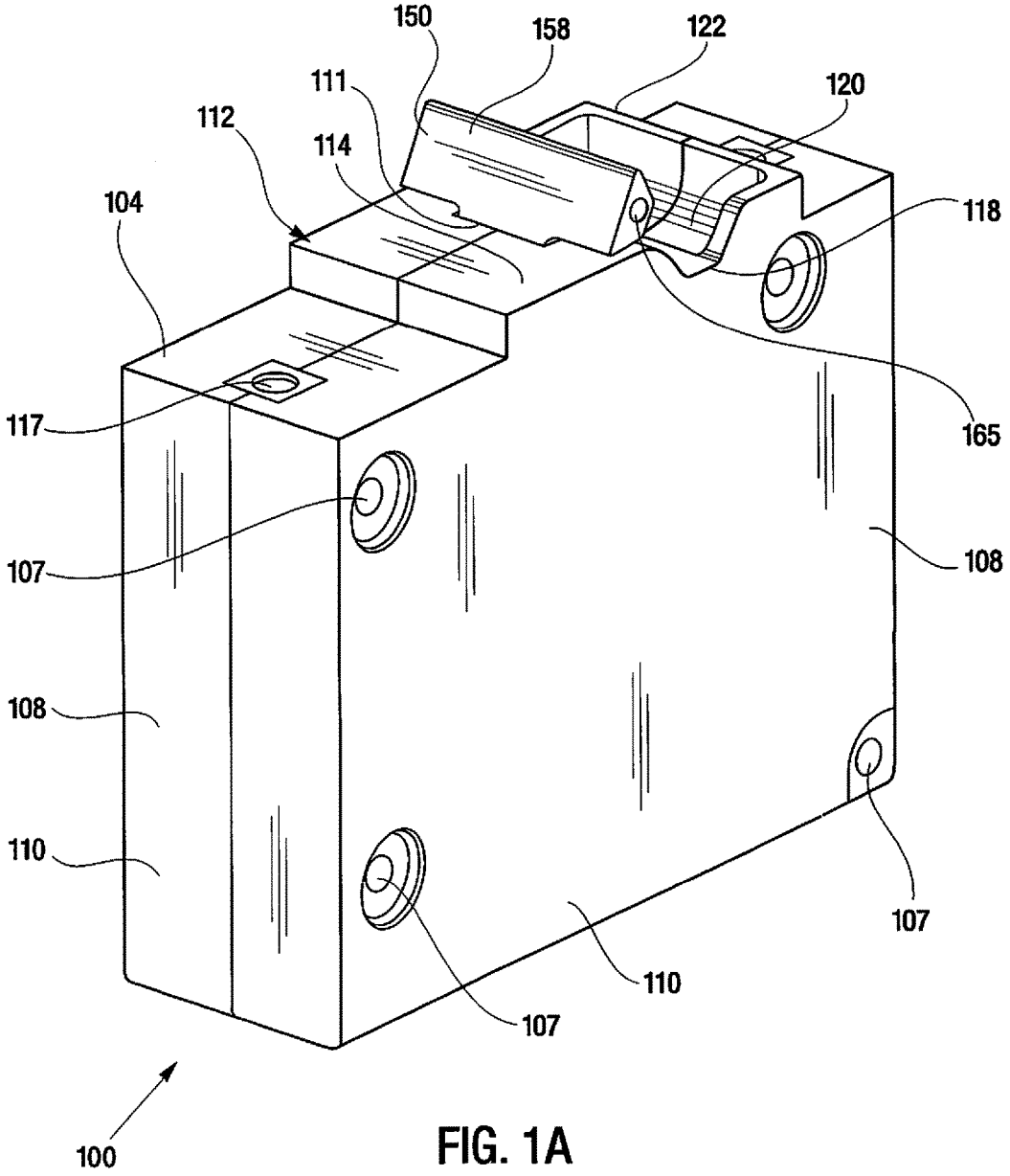
FIG. 1A is a front view of a switch assembly at the "off position" in accordance with the subject disclosure.
Figure 1B:
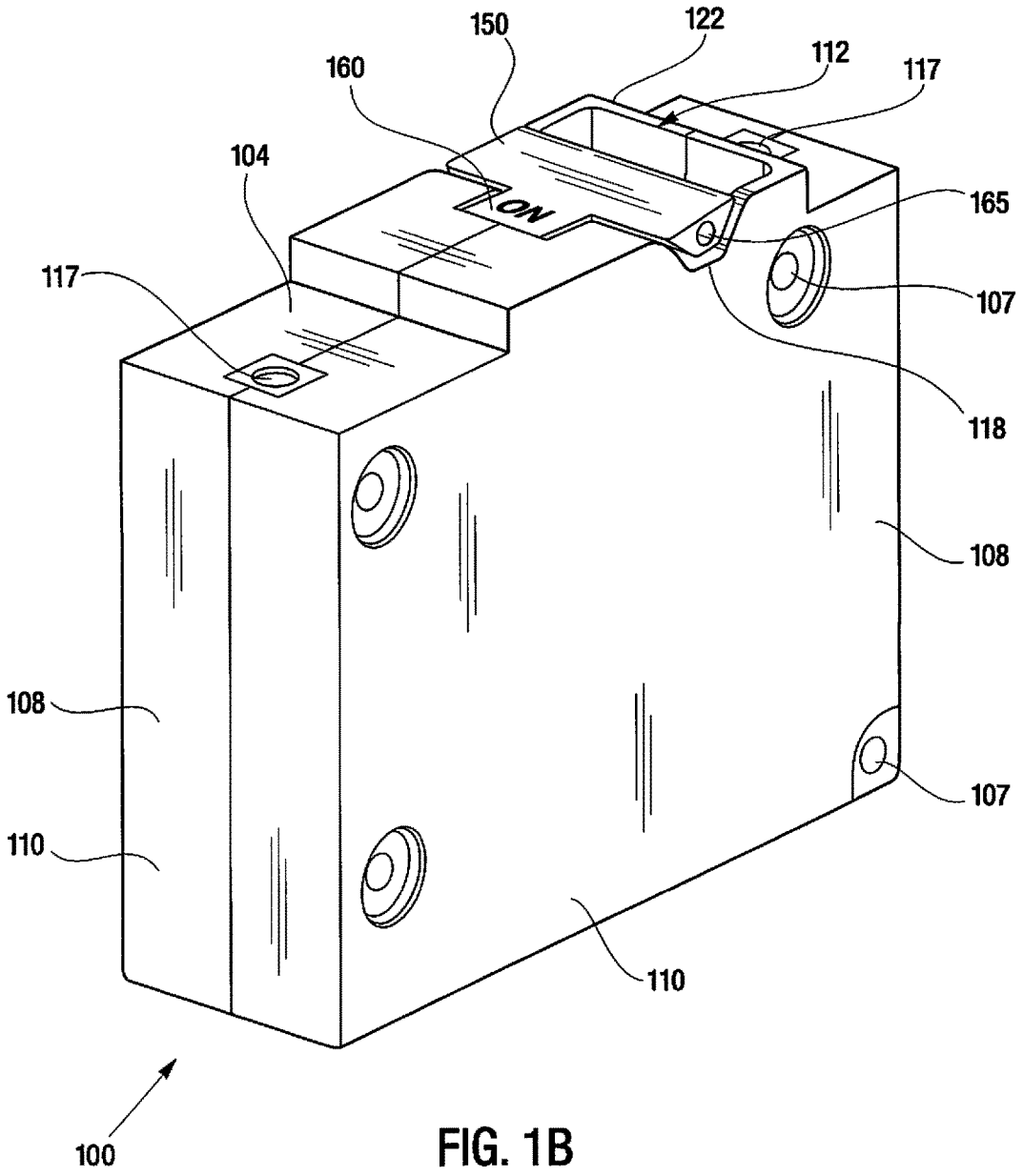
FIG. 1B is a front view of a switch assembly at the "on" position in accordance with the subject disclosure.
Figure 1C:
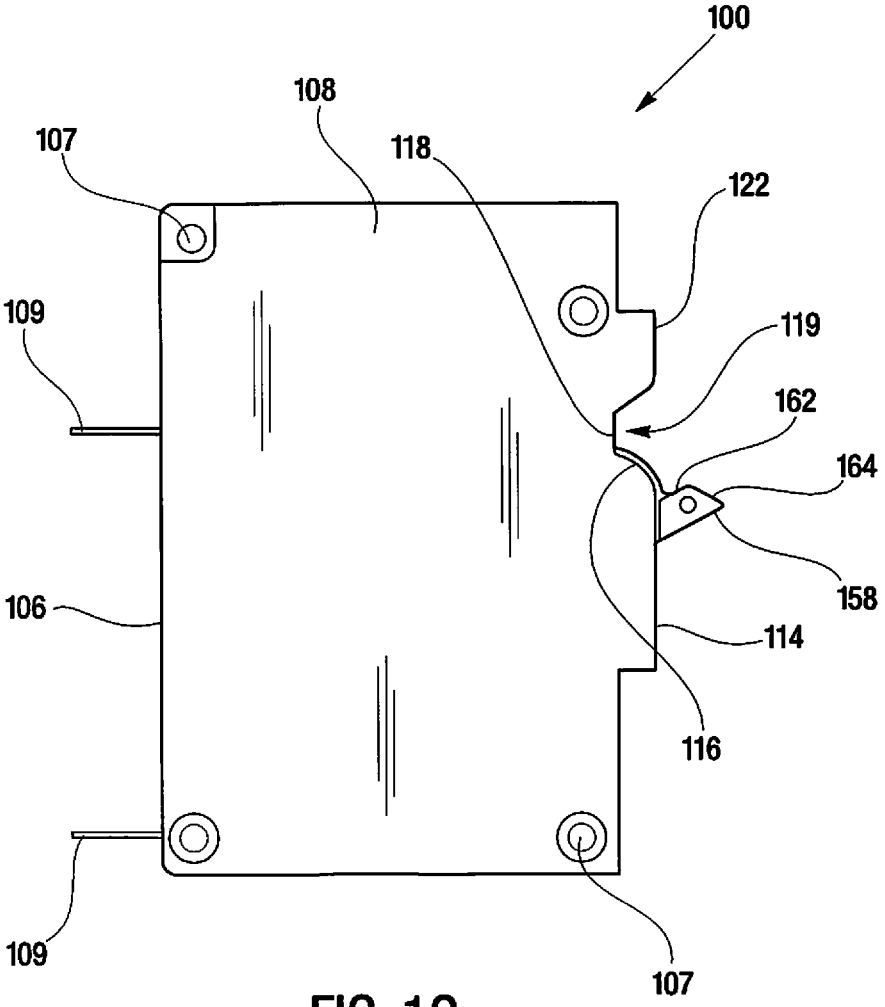
FIG. 1C is a side view of a switch assembly at the "off position" in accordance with the subject disclosure.
Figure 1D:
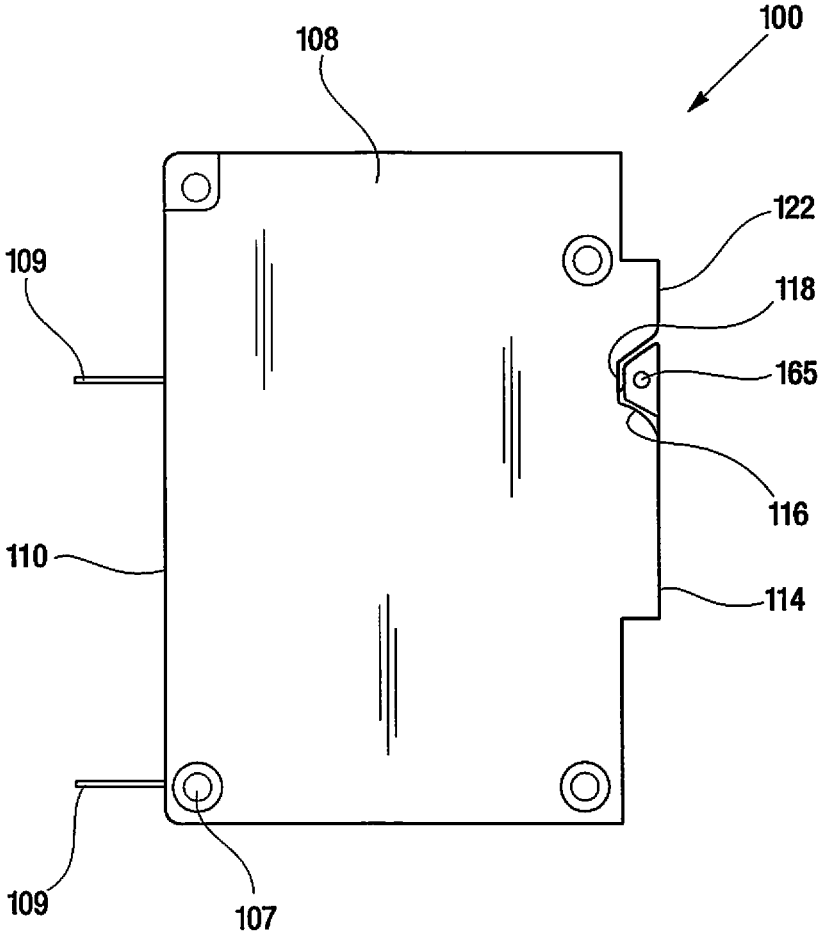
FIG. 1D is a side view of a switch assembly at the "on" position in accordance with the subject disclosure.
Figure 1E:
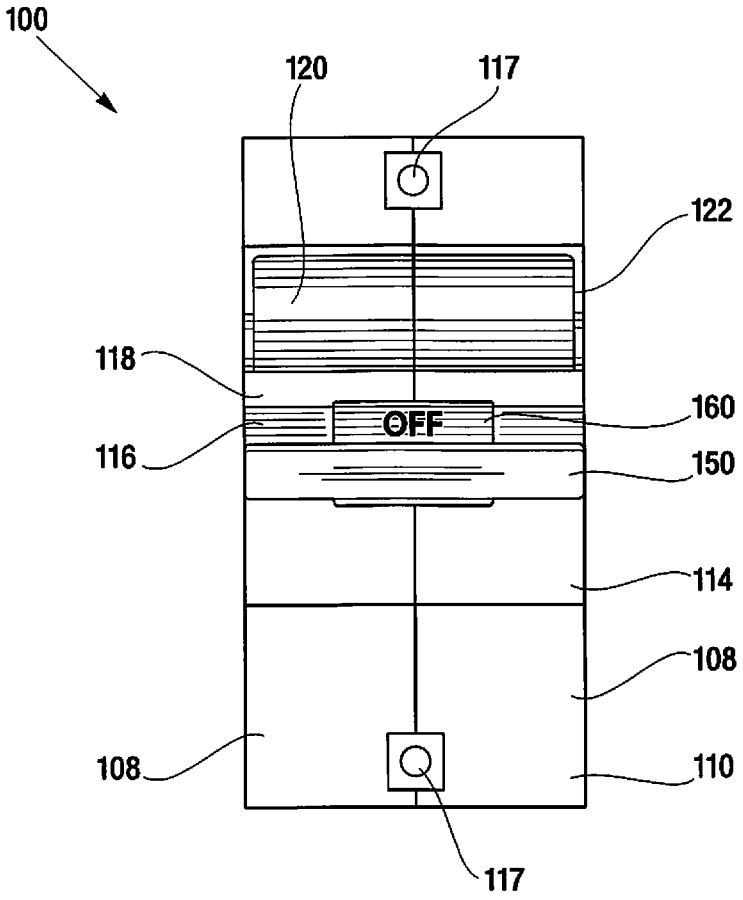
FIG. 1E is a top view of a switch assembly at the "off position" in accordance with the subject disclosure.
Figure 1F:
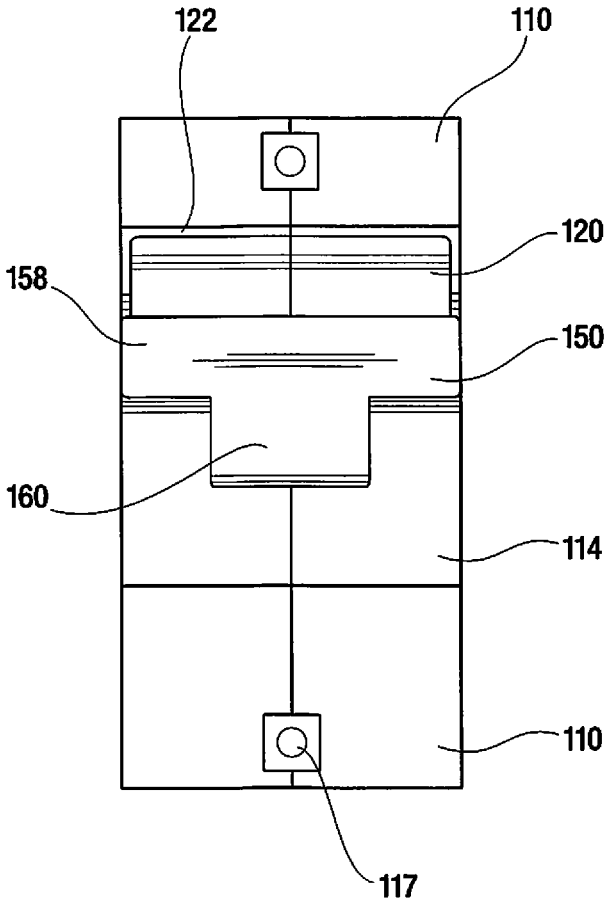
FIG. 1F is a top view of a switch assembly at the "on" position in accordance with the subject disclosure.

The subject technology overcomes many of the prior art problems associated with inadvertent operation of switches. The advantages, and other features of the technology disclosed herein, will become more readily apparent to those having ordinary skill in the art from the following detailed description of certain preferred embodiments taken in conjunction with the drawings which set forth representative embodiments of the present technology and wherein like reference numerals identify similar structural elements. In brief overview, the subject technology is a low profile switch assembly with a handle that will not be typically be actuated inadvertently and is snap resistant. The switch assembly is typically mounted behind a panel that includes an opening surrounding a portion of the switch assembly. One application of the subject technology is in hydraulic-magnetic circuit breakers but it is equally applicable to other areas and types.

Referring now to the FIGS. 1A-F, there is shown a perspective view of a switch assembly 100 in accordance with the subject technology. The switch assembly 100 has a housing 102 with a front surface 104 and a rear surface 106. Opposing sidewalls 108 extend between the front and rear surfaces 104, 106 to form an interior 105. The housing 102 is formed from two halves 110 which are held together with fasteners (not shown) such as rivets or screws inserted through housing holes 107. Typically, terminals 109 would extend from the rear surface 106. Any type terminal may be utilized. Panel inserts 117 allow coupling the switch assembly 100 to a panel (not shown).

An escutcheon portion 112 on the front surface 104 partially encloses a handle 150, which passes through a slot 111 formed in the housing 102. The escutcheon portion 112 would be sized and configured to pass through an opening in a panel (not shown). Various configurations are envisioned depending upon the panel thickness, size of the opening and the like. The escutcheon portion 112 has a raised platform 114 and a transition ramp 116 extending from the platform 114 to a planar rest area 118. A sunken finger area 120 is adjacent the planar rest area 118. The escutcheon portion 112 also includes a perimeter frame 122 enclosing the finger area 120. As such, the perimeter frame 122 acts as a guard providing minimum height raised protection even if the surrounding panel (not shown) is relatively thinner. The escutcheon portion 112 defines opposing notches 119 aligned with the planar rest area 118.

The handle 150 is used to actuate the switch assembly 100 between the "on" and "off" positions in, respectively. The handle 150 has a finger grip 158. The finger grip 158 includes printing portions 160 that typically have the words "off" and "on" imprinted thereon. Depending upon the configuration, other words and/or symbols could also be printed on the printing portions 160. A planar surface 162 of the finger grip 158 selectively abuts against the rest area 118. The user typically interacts with a textured portion 164 extending between the planar surface 162 and the printing portion 160. As would be appreciated by one of ordinary skill in the art, the switch assembly 100 has a handle 150 well protected from inadvertent operation by the escutcheon portion 112.

Figure 2:
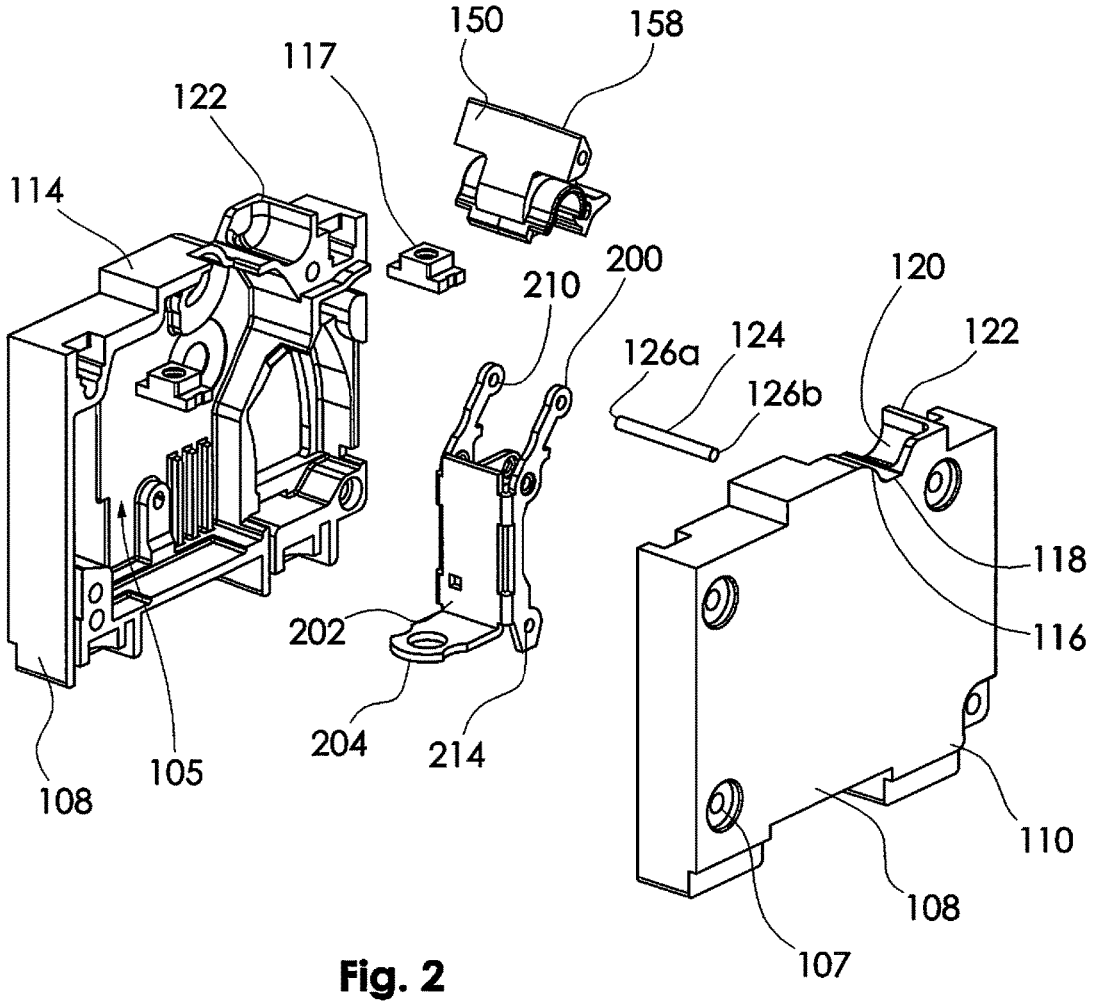
FIG. 2 is an exploded view of a switch assembly in accordance with the subject disclosure.
Figure 5A:
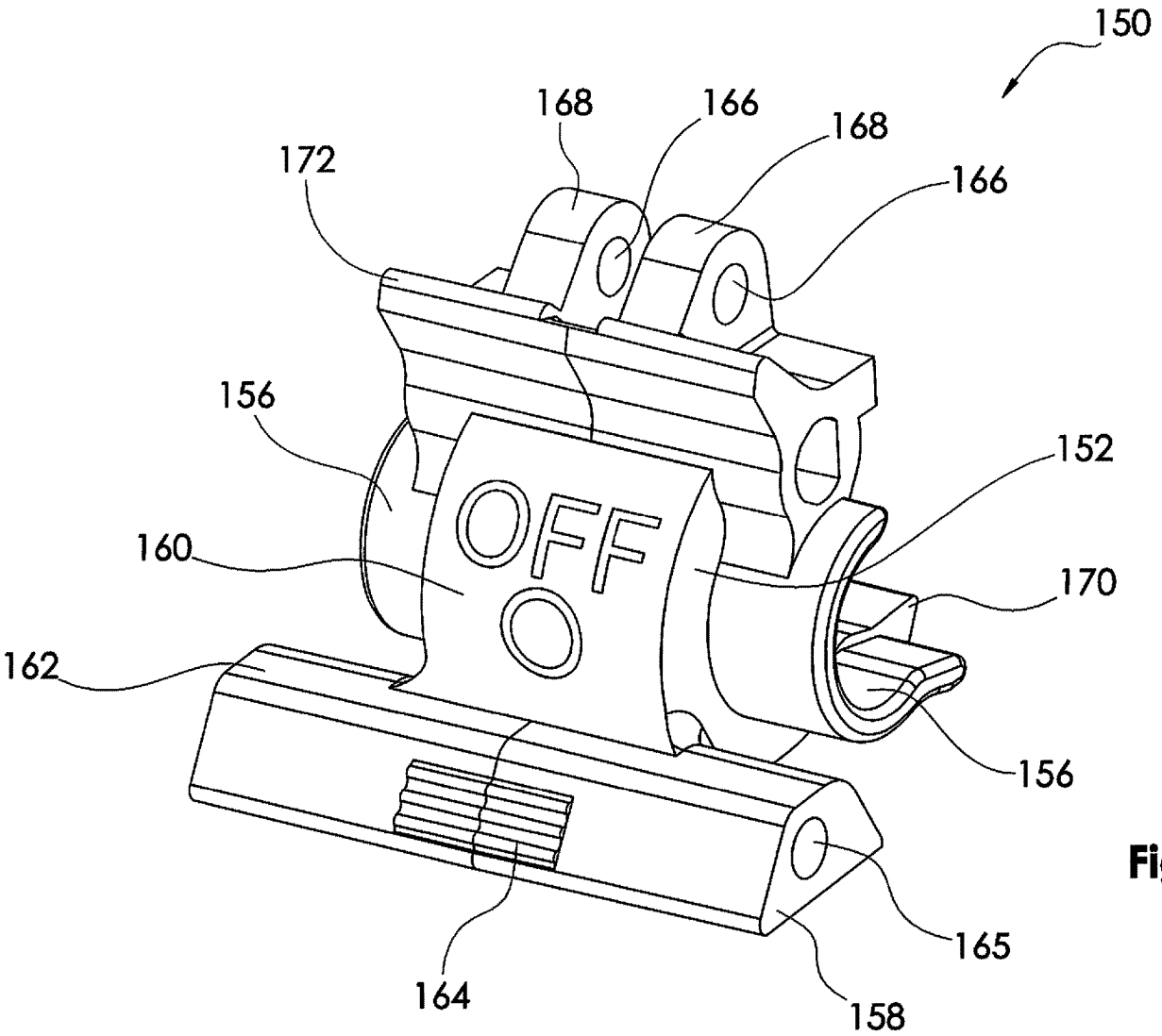
FIGS. 5A-E are various views of a handle for a switch assembly in accordance with the subject disclosure.
Figure 5B:
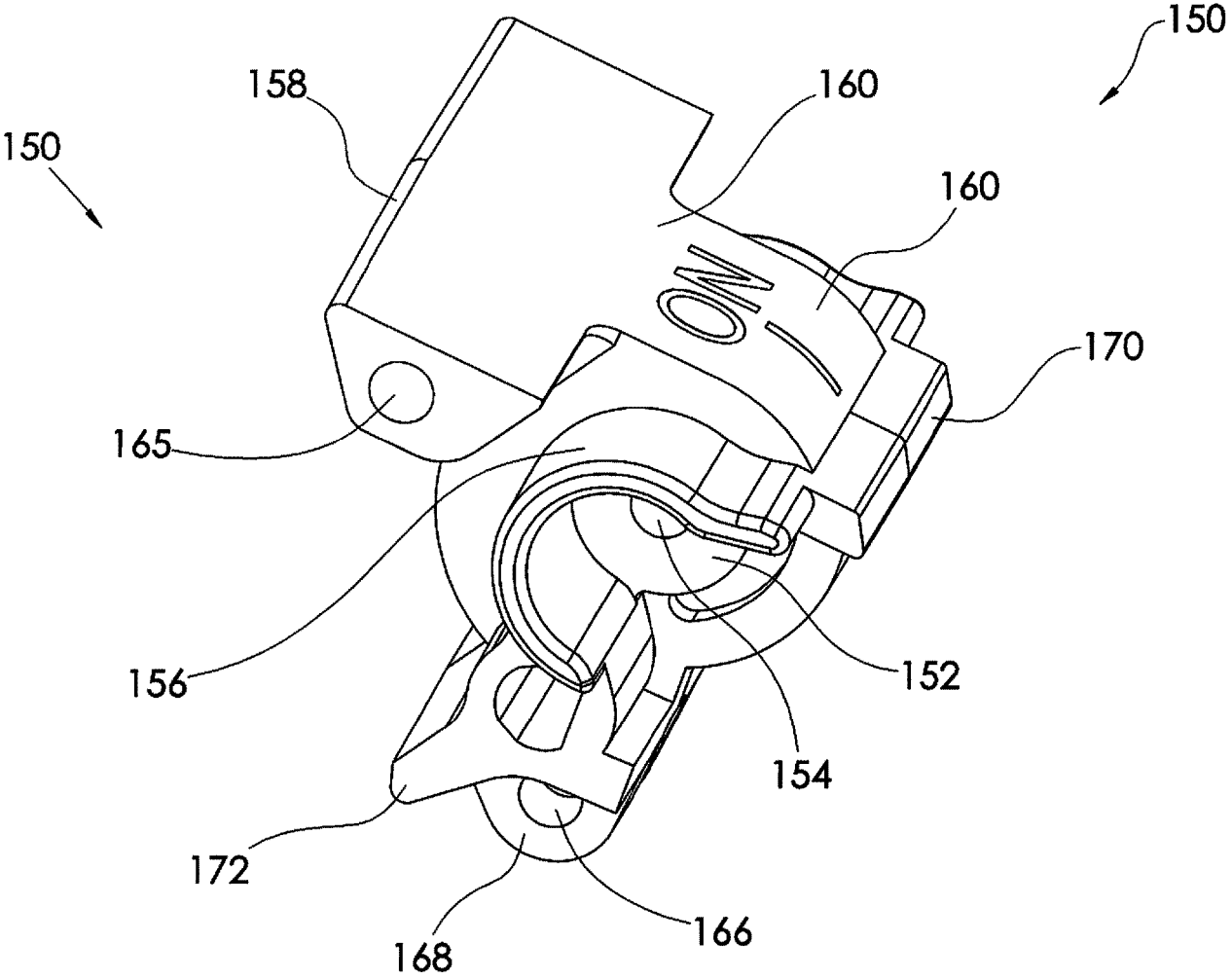
Figure 5C:
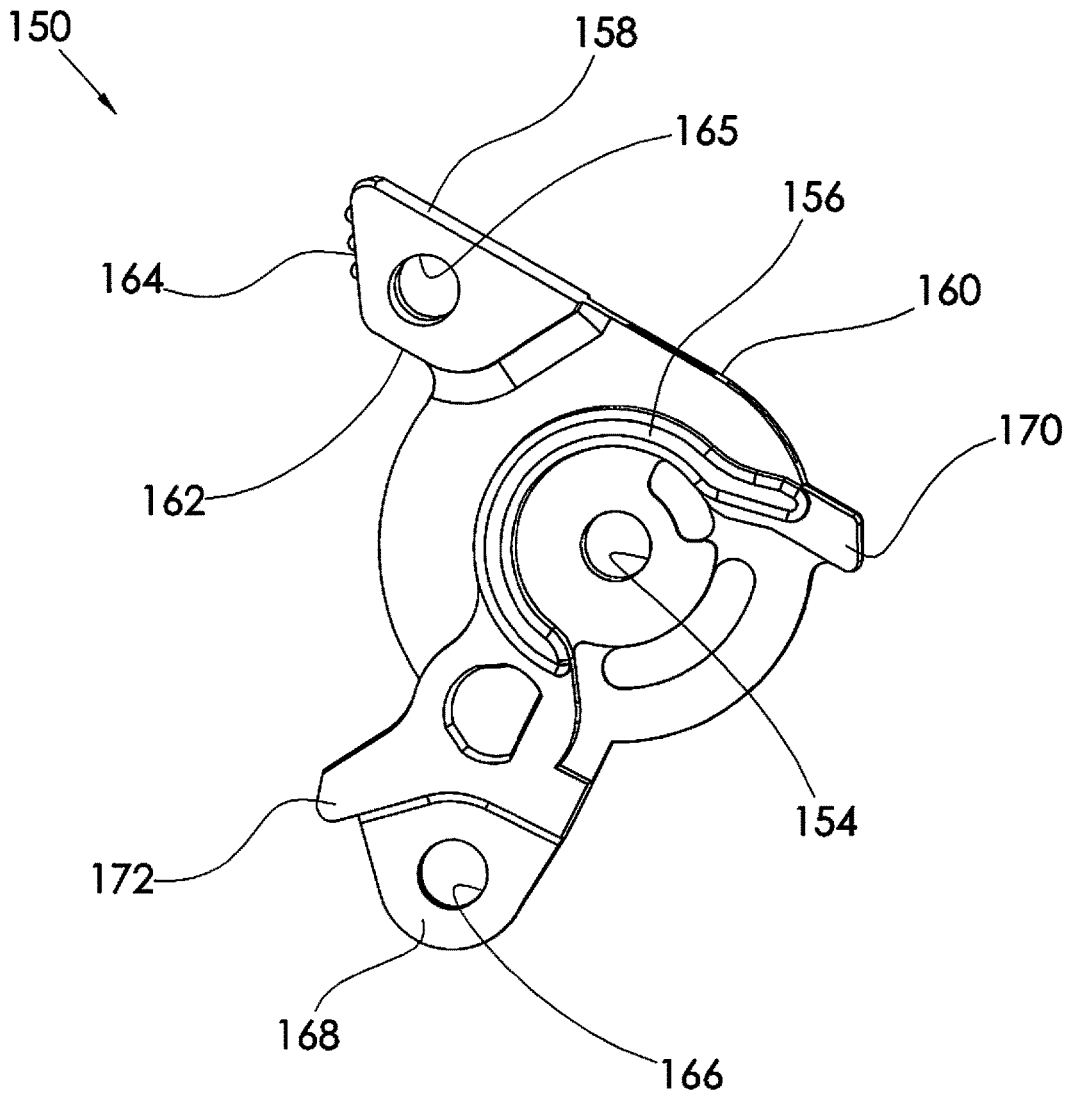
Figure 5D:
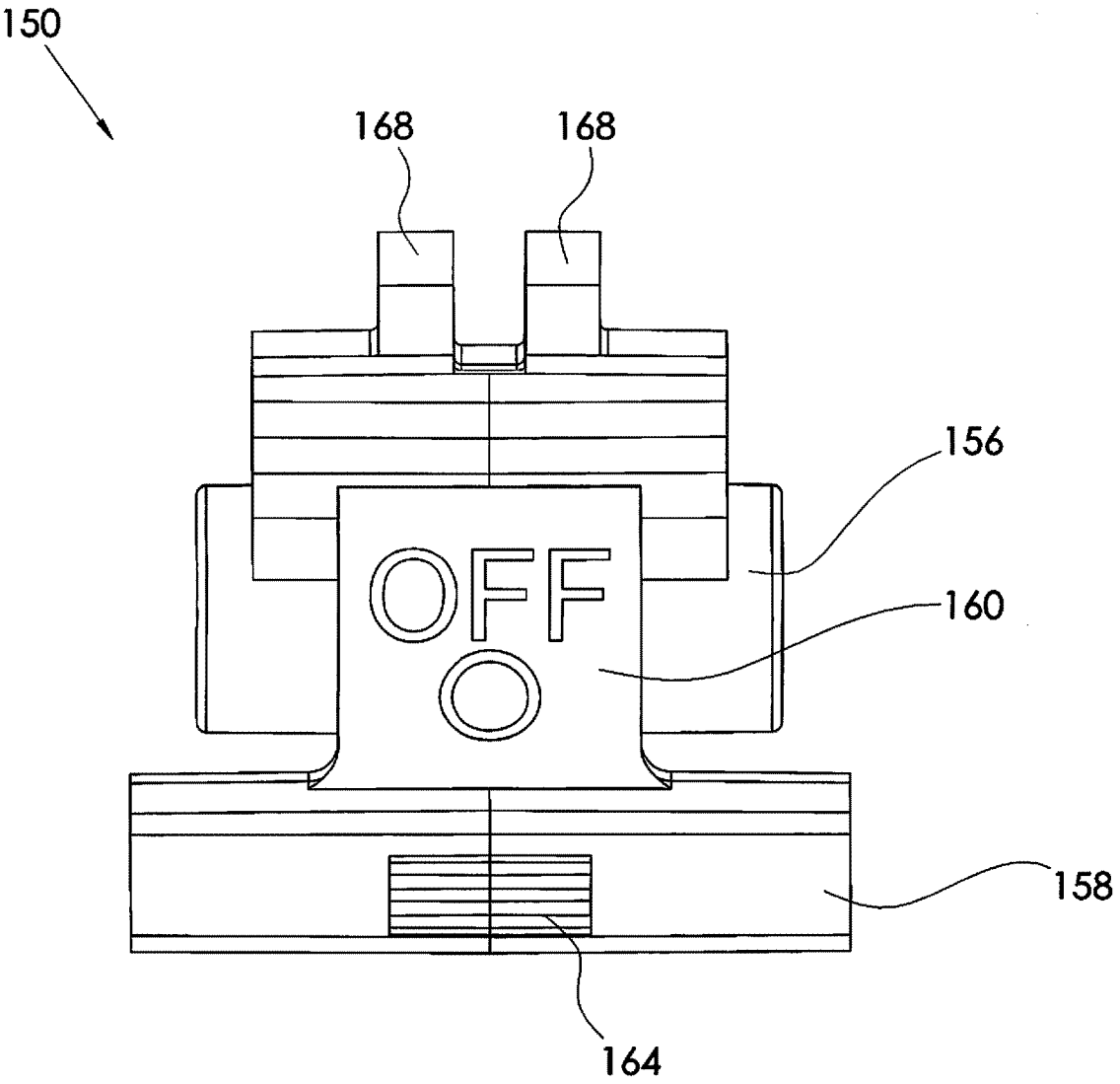
Figure 5E:
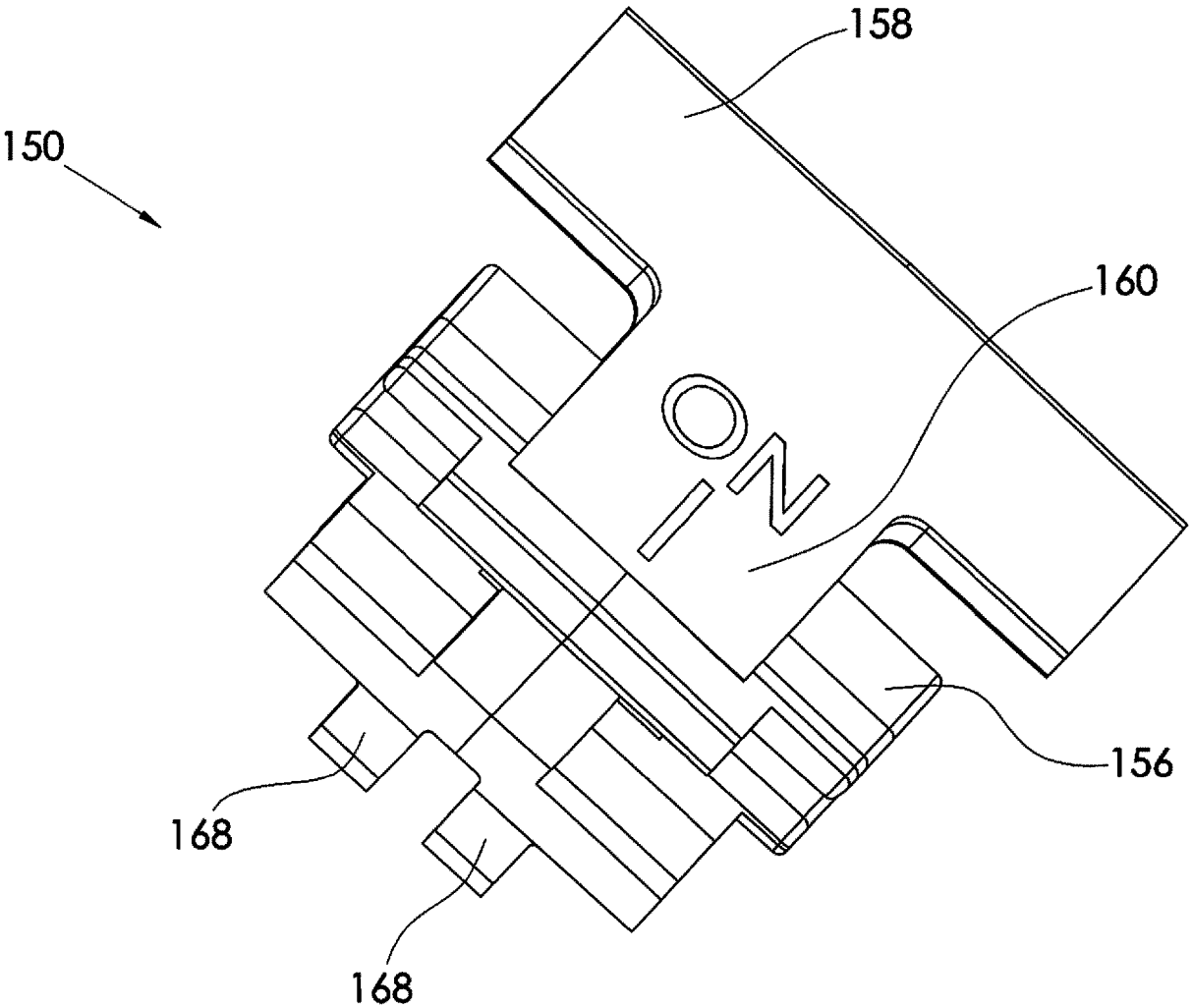
Figure 6:
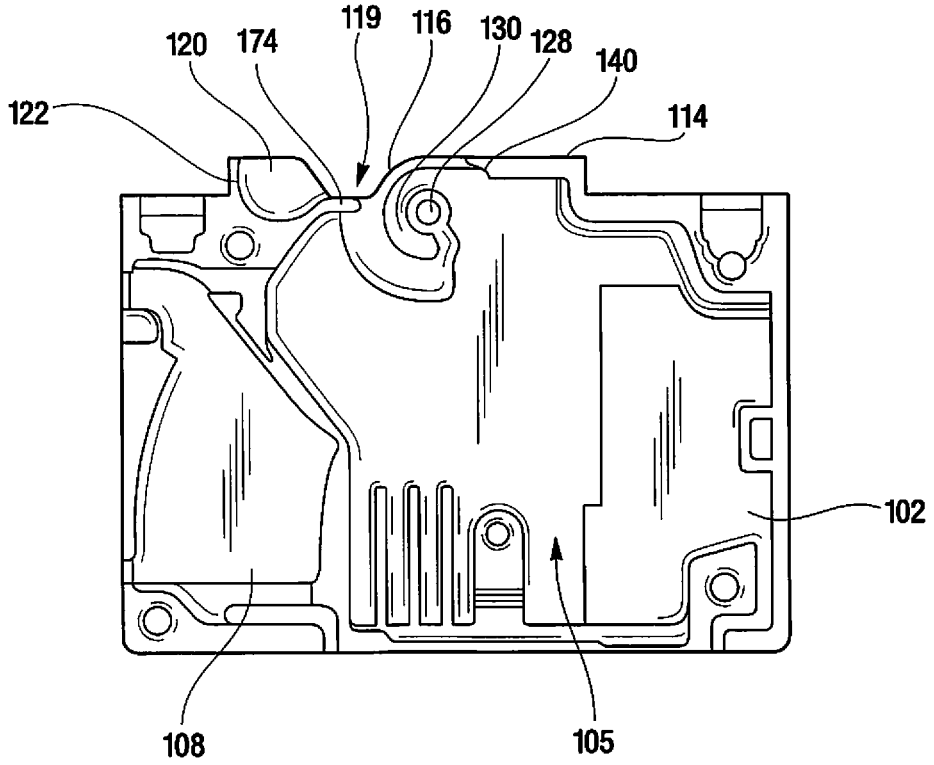
FIG. 6 is an inside view of one half of the housing for a switch assembly in accordance with the subject disclosure.

Referring now to FIG. 2, an exploded view of a switch assembly 100 is shown. The handle 150 has a hub 152 with an axial bore 154 (best seen in FIG. 5C). The finger grip 158 extends from the hub 152. Webbing 156 extends from the hub 152. The webbing 156 does not completely encircle the hub 152 but provides ample spacing and protection for the user. For example, the webbing 156 insures proper over-surface creep distance. The webbing 156 also rides in a slot 130 (best seen in FIG. 6). In effect, the handle 150 is coupled to the housing 102.

The handle 150 is also mounted to the housing 102 by a pivot pin 124 passing through the axial bore 154. Each end 126*a*, 126*b* of the pivot pin 124 is captured in an inner cup 128 (see FIG. 6) formed in each half 110 of the housing 102. The housing 102 forms the arcuate slots 130 around each cup 128. The slots 130 are approximately 180 degrees. Although only one of these approaches is sufficient, coupling the handle 150 in the housing 102 using the webbing 156 slidably captured in the slots 130 and the pivot pin 124 captured in the cups 128 provides robust support of the handle 150.

For still further support of the handle 150 and other components, a frame 200 mounts to the housing 102 for providing mounting locations for the various components. The frame 200 has a planar body 202 with a coupling tab 204 for mounting to the housing 102. The frame 200 has opposing arms 206 extending from the body 202 with distal ends 208 defining openings 210. For additional support of the handle 150, the pivot pin 124 also pass through the openings 210. In another embodiment, the frame 200 does not extend distally so that the pivot pin 124 is solely supported by the housing cups 128, pivot pin 124 or the combination thereof. In still another embodiment, the frame arms 206 solely and fully support the handle 150. The frame 200 also forms an intermediate pair 212 of opposing openings and a bottom pair 214 of opposing openings. Each pair 212, 214 can support additional pins that carry rotating components.

Figure 3:
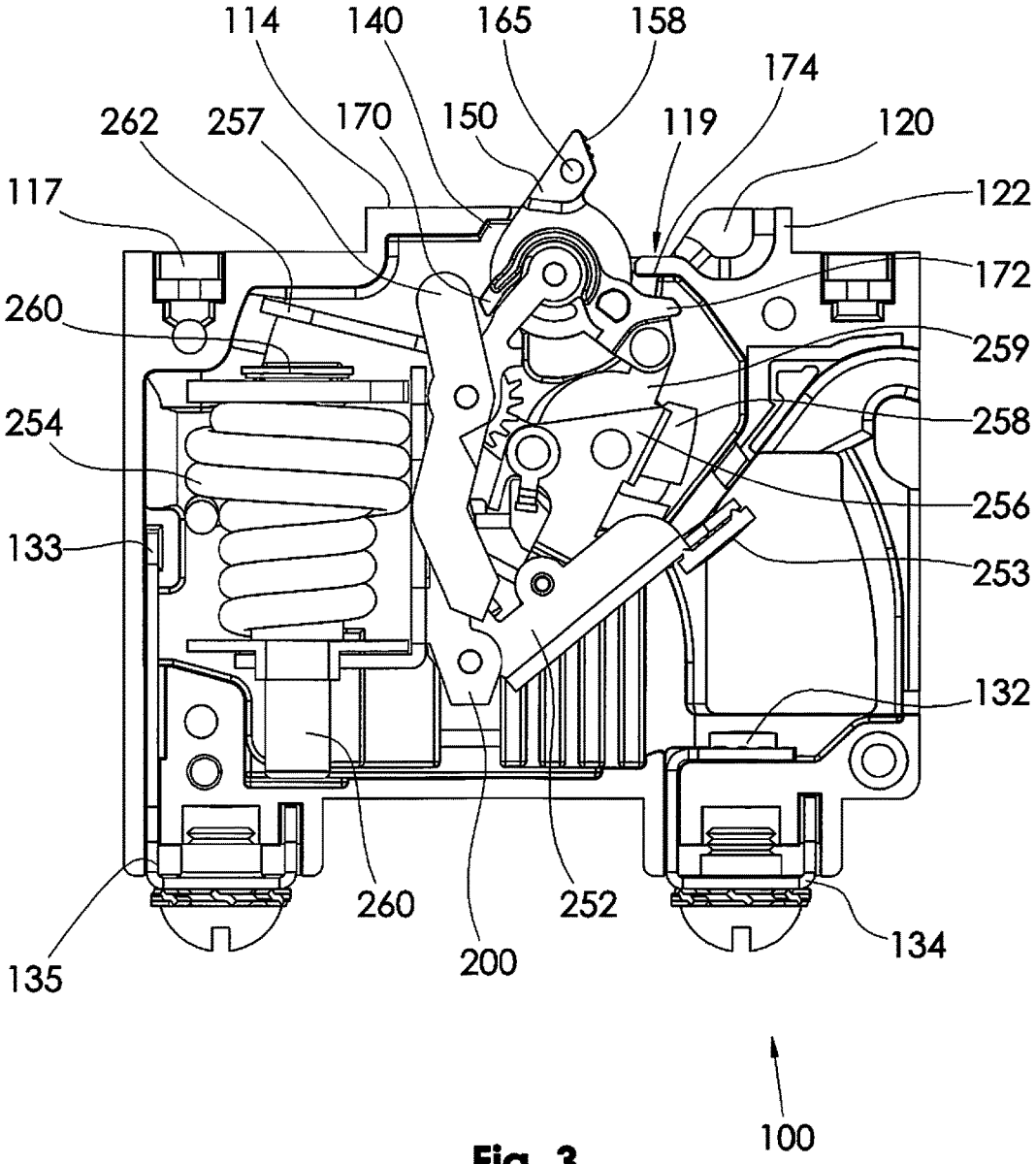
FIG. 3 is an interior view of a switch assembly at the "off" position in accordance with the subject disclosure.
Figure 4:
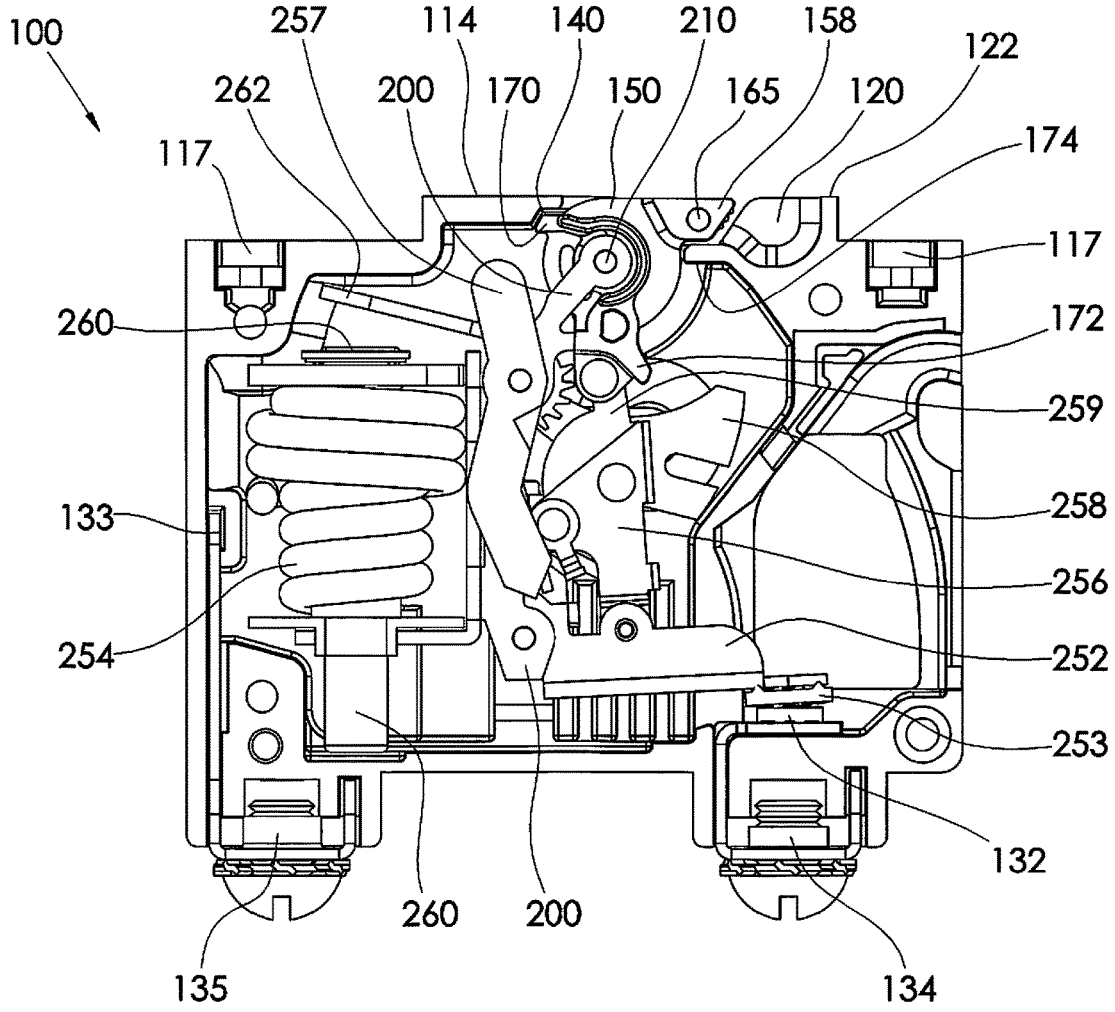
FIG. 4 is an interior view of a switch assembly at the "on" position in accordance with the subject disclosure.

Referring now to FIGS. 3 and 4, interior views of the switch assembly 100 at the "off" and "on" positions are shown. The handle 150 couples to a collapsible latching mechanism 250, which is also supported by the housing 102 and the frame 200. The latching mechanism 250 locks the handle 150 in the selected position while also automatically tripping the switch assembly 100 to the off position when certain conditions are met. The handle 150 is also spring biased to remain in the user-selected position. The latching mechanism 250 can have various components tuned to trigger under various conditions and at various speeds. In one embodiment, the switch assembly 100 is acceptable for use up to 600 V but typically trips at a preselected current level.

The latching mechanism 250 includes a movable contact bar 252 with a contact 253 that engages a first contact 132 of the first terminal portion 134 in the "on" position. As would be appreciated by those of ordinary skill in the art, the switch assembly 100 of FIGS. 3 and 4 has a different terminal configuration from those shown in other figures. The contact bar 252 is coupled to a coil 254 that couples to a second contact 133 of a second terminal portion 135. The contact bar 252 is also coupled to the frame 200 via the bottom opening pair 214. In the "off" position, the contact bar 252 moves away from the first contact 132 to interrupt electrical continuity between the terminals 134, 135. The contact bar 252 is moved by connection to a linkage 256. The linkage 256 is driven by connection to bores 166 formed in shoulders 168 of the handle 150. The contact bar 252 is also anchored to the frame 200 via the intermediate opening pair 212.

The linkage 256 locks the contact bar 252 in the "on" position but a release armature 258 and cam 259 are capable of tripping to move the contact bar" to the "off" position in the event of an over-current. The release armature 258 is rotationally mounted so that a first end 262 is adjacent a delay tube 260 in the "on" position. During normal operation, even though the coil 254 wraps around the metallic delay tube 260, the delay tube 260 is not sufficiently magnetized to attract the first end 262 of the release armature 258 thereto. However, as operational parameters such as current in the coil 254 increase, the increased magnetic field magnetizes the delay tube 260 so that the release armature 258 is attracted thereto. As the first end 262 of the release armature 258 is magnetically drawn to the delay, the release armature 258 trips the contact bar 252 into the "off" position. A multi-trip lever 257 mechanically transfers the "trip" signal from one pole to the adjacent poles. As would be appreciated by those of ordinary skill in the art, the coil 254, delay tube 260, release armature 258 and various components such as position of the connections can be tuned to create triggering at predetermined conditions.

Referring now to FIGS. 5A-E, various views of the handle 150 are shown. The handle 150 is sized and configured to provide spacing and safe operation yet advantageously the switch assembly 100 maintains a relatively low overall profile. For example, the hub 152 and webbing 156 prevent the user from contact with any internal live components. The handle 150 includes an "on" side safety protrusion 170 that fits in a hollow 140 formed underneath the platform 114 in the interior 105 of the housing 102 (best seen in FIGS. 4 and 6) in the "on" position. The handle 150 also includes an "off" side safety protrusion 172 that preferably abuts or is at least adjacent to a ledge 174 formed underneath the rest area 118 in the interior 105 of the housing 102 (best seen in FIGS. 3 and 6) in the "off" position. These safety protrusions 170, 172 provide ample spacing and protection from live components for the user.

The finger grip 158 of the handle 150 defines an axial passage 165 extending between the notches 119 when the handle 150 is in the "on" position. As a result, multiple switches 100 can be mounted adjacently and the handles 150 can be ganged together by placing one or more connecting rods through the axial passages 165.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., linkages, armatures, fasteners, springs, coils, and the like) shown as distinct for purposes of illustration may be incorporated within other functional elements in a particular implementation. Further, although the subject technology has been described with respect to the field of circuit breakers, it is envisioned that the subject technology would be equally applicable to other fields and applications such as on one, two or three pole configurations regardless of the wiring and orientation.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims. For example, each claim may depend from any or all claims in a multiple dependent manner even though such has not been originally claimed.

What is claimed is:

1. An escutcheon portion of a switch assembly having a housing having a front surface, the escutcheon portion comprising:

a handle rotatably mounted in an interior of the housing for movement between an on position and an off position;

a platform on the front surface;

a planar rest area separated from the platform and relatively lower with respect to the platform, wherein the handle is adjacent the planar rest area in the on position;

a transition ramp extending from the platform to the planar rest area;

a finger area adjacent the planar rest area; and a perimeter frame enclosing the finger area so that, when the handle is in the on position, a finger can be inserted into the finger area to manually actuate the handle into the off position, wherein in the off position, the handle extends above the platform.

2. An escutcheon portion of a switch assembly having a housing having a front surface, the escutcheon portion comprising:

a handle rotatably mounted in an interior of the housing for movement between an on position and an off position;

a platform on the front surface;

a planar rest area separated from the platform and relatively lower with respect to the platform, wherein the handle is adjacent the planar rest area in the on position;

a transition ramp extending from the platform to the planar rest area;

a finger area adjacent the planar rest area; and a perimeter frame enclosing the finger area so that, when the handle is in the on position, a finger can be inserted into the finger area to manually actuate the handle into the off position, wherein the planar rest area, the ramp, and the perimeter frame define opposing notches; and a portion of the handle is adjacent to the planar rest area in the on position and has a cross-sectional profile that is substantially trapezoidal to match a shape of the notches.

3. A switch assembly comprising:

a housing defining an interior and having: a front surface; a rear surface opposing the front surface; and opposing first and second sidewalls extending between the front and rear surfaces;

an escutcheon portion on the front surface, the escutcheon having: a platform raised above the front surface; a transition ramp extending from the platform to a planar rest area; a finger area adjacent the planar rest area; and a perimeter frame enclosing the finger area so that the escutcheon portion defines opposing notches aligned with the planar rest area;

a handle having: a hub with an axial bore; and a finger grip extending from the hub, the finger grip having a planar surface for selectively abutting against the rest area and a textured portion for manual actuation;

a frame mounted within the housing and having opposing arms, each arm having a distal end defining an opening; and a pivot pin inserted through the openings of the arm's distal ends and the axial bore to rotatably coupled the handle to the frame.

4. A switch assembly as recited in claim 3, wherein the housing is formed from two opposing halves and the switch device is a circuit breaker.

5. A circuit breaker assembly comprising:

a pair of circuit breakers, each circuit breaker including:

a housing having a front surface and defining an interior;

a handle rotatably mounted in the interior for movement between an on position and an off position; and a perimeter frame enclosing a rest area and defining opposing notches that are aligned with the rest area, wherein when the handle is in the on position, the handle is adjacent the rest area and the handle defines a bore aligned with the notches; and a linkage coupled to the bores so that if either handle is actuated, both handles are actuated.

6. A circuit breaker assembly as recited in claim 5, wherein at least one of the perimeter frames encloses a linger area so that a finger can be inserted into the finger area to manually actuate one of the handles from the on position into the off position.

7. A circuit breaker assembly as recited in claim 5, wherein each circuit breaker includes:

a platform on the front surface; and the planar rest area separated from the platform and relatively lower with respect to the platform so that in the on position, the handle is flush or below the platform.

8. A switch assembly comprising:

a housing defining an interior and having: a front surface; a rear surface opposing the front surface; and opposing first and second sidewalls extending between the front and rear surfaces;

an escutcheon portion on the front surface, the escutcheon having: a platform on the front surface; a transition ramp extending from the platform to a rest area; a finger area adjacent the rest area; and a perimeter frame enclosing the finger area so that the escutcheon portion defines opposing notches aligned with the rest area; and a handle having: a hub rotatably mounted in the interior; and a finger grip extending from the hub through a slot formed in the transition ramp, the finger grip having a textured portion and a surface for abutting against the rest area in a first position, wherein the handle selectively moves to a second position by manual operation or automatically when a predetermined condition is met.

9. A switch assembly as recited in claim 8, wherein the handle includes webbing and the housing defines opposing slots for rotatably receiving the webbing and supporting the handle in the interior.

10. A switch assembly as recited in claim 8, wherein the handle defines an axial bore through the hub and further comprising: a frame mounted to the housing and having opposing arms, each arm having a distal end defining an opening; and a pivot pin inserted through the openings of the arm's distal ends and the axial bore to rotatably couple the handle to the frame.

11. A switch assembly as recited in claim 8, wherein the handle has safety protrusions extending from the hub.

12. A switch assembly as recited in claim 8, wherein the planar rest area is substantially co-planar with the front surface.

13. A switch assembly as recited in claim 8, wherein the housing is formed from two opposing halves and the switch device is a circuit breaker.

14. A switch assembly as recited in claim 8, wherein the finger grip of the handle defines an axial passage extending between the notches when the handle is in the first position.

15. An escutcheon portion of a switch assembly having a housing having a front surface, the escutcheon portion comprising:

a handle rotatably mounted in an interior of the housing for movement between an on position and an off position;

a platform on the front surface;

a planar rest area separated from the platform and relatively lower with respect to the platform, wherein the handle is adjacent the planar rest area in the on position;

a transition ramp extending from the platform to the planar rest area;

a finger area adjacent the planar rest area; and a perimeter frame enclosing the finger area so that, when the handle is in the on position, a finger can be inserted into the finger area to manually actuate the handle into the off position, wherein in the on position, the handle is flush with the platform.

16. An escutcheon portion of a switch assembly as recited in claim 15, wherein the transition ramp defines a slot for allowing rotational movement of the handle, the handle having a finger grip with a planar surface for selectively abutting against the planar rest area in the on position and a textured portion for manual actuation by placement of the finger in the finger area.

17. An escutcheon portion of a switch assembly as recited in claim 15, wherein the platform is raised above the front surface.

18. An escutcheon portion of a switch assembly as recited in claim 15, wherein in the off position, the handle extends above the platform.

19. An escutcheon portion of a switch assembly as recited in claim 15, wherein the planar rest area, the ramp, and the perimeter frame define opposing notches.

20. An escutcheon portion of a switch assembly as recited in claim 19, wherein a portion of the handle is adjacent to the planar rest area in the on position and has a cross-sectional profile that is substantially trapezoidal to match a shape of the notches.

21. An escutcheon portion of a switch assembly as recited in claim 20, wherein in the on position, the handle extends into the notches and defines a bore extending between the notches.

* * * * *